US005132702A

United States Patent [19]

Shiozaki et al.

[11] Patent Number: 5,132,702

[45] Date of Patent: Jul. 21, 1992

[54] LIQUID JET RECORDING APPARATUS AND METHOD

[75] Inventors: Atsushi Shiozaki, Kawasaki; Hiroto Matsuda, Ebina, both of Japan

[73] Assignee: Canon Kabushiki Kaisha, Tokyo, Japan

[21] Appl. No.: 475,797

[22] Filed: Feb. 6, 1990

[30] Foreign Application Priority Data

Feb. 8, 1989 [JP] Japan ..... 1-27636

[51] Int. Cl.[5] ..... B41J 2/05

[52] U.S. Cl. ..... 346/1.1; 346/140 R; 346/75

[58] Field of Search ..... 346/140 PD, 75, 1.1, 346/140 R; 358/296

[56] References Cited

U.S. PATENT DOCUMENTS 4,272,771 6/1981 Furukawa ..... 346/75
4,712,172 12/1987 Kiyohara et al. ..... 346/1.1
4,769,653 9/1988 Shimoda ..... 346/140 R
4,827,279 5/1989 Lubinsky et al. ..... 346/1.1
4,873,536 10/1989 Minowa et al. ..... 346/1.1
4,908,635 3/1990 Iwasawa et al. ..... 346/140 R
4,965,608 10/1990 Shinohara et al. ..... 346/1.1

FOREIGN PATENT DOCUMENTS 0159402 10/1985 European Pat. Off. .
62-092851 4/1987 Japan .

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

A serial type liquid jet recording apparatus includes a recording head having an array of plural liquid ejecting devices arranged in a column direction to eject droplets of recording liquid on a recording material; an end portion driving circuit for driving one or more end liquid ejecting devices of the plural ejecting devices; a central portion driving circuit for driving the remaining liquid jet ejecting devices; and an adjusting device for adjusting a quantity of the droplet only from the end ejecting devices by changing a voltage level or a pulse width of a driving voltage of the end portion driving circuit independently of the central portion driving circuit.

18 Claims, 4 Drawing Sheets

LIQUID JET RECORDING APPARATUS AND METHOD

FIELD OF THE INVENTION AND RELATED ART

The present invention relates to a liquid jet recording apparatus and a liquid jet recording method, more particularly to such apparatus and method of serial scanning type.

A serial type liquid jet recording apparatus is known wherein small droplets of ink are shot on a recording material to record information such as characters, marks and images, using a liquid jet recording head having plural liquid ejection outlets.

In the conventional liquid jet recording apparatus, in order to record information on the recording material, the recording head is driven to scan along a line, that is, in the line (horizontal or main scan) direction, while the recording material is moved along a column, that is, in the column (vertical or sub scan) direction. Thus, the recording head moves relative to the recording material. In other words, the recording operation in a linear zone having a width equal to the recording head width measured in the column direction is repeated to provide the print.

In a conventional liquid jet recording apparatus, a discontinuity is produced between adjacent linear zones, and it looks like a stripe or stripes.

FIG. 1 shows a recording portion of a conventional serial type recording apparatus. The recording material is designated by a reference numeral 101. The apparatus includes a recording head 103, an ink container 105 and a platen 106. A reference numeral 112 designates the linear zone recording, and 113 designates the joint portion between the adjacent linear zones. The stripe appears in the connecting portion 113.

There are plural causes for the production of the stripe, but all of the causes are not yet found. However, the recent investigations have revealed that one of the major causes is that the degree of spread (blot) of the liquid in the recording material is different at the continuing portion (junction) 113 between the adjacent linear recording zones 112 than the other portion, for example, the central portion in the linear zone.

More particularly, adjacent the opposite end portions of the recording zone 112 in the column direction (usually vertical direction), the area of the spread is large, and therefore, the liquid droplets in the next linear zone are shot on the spread area. For this reason, even if the recording material 101 is fed with high precision to provide very regular intervals between a picture element of one linear zone and the picture element in the next linear zone, the density of the record is locally high in the connecting portion 113, so that a stripe having a high density appears.

Referring to FIG. 2, the above phenomenon will be described in more detail. FIG. 2 is an enlarged view of the recording head 103 of FIG. 1 as seen from the side of the recording material. A reference numeral 112 designates a record on the recording material 101 in a linear recording zone. At the end portions of the recording zone in the vertical direction (column direction), the liquid is spread more than in the central part of the recording zone, as indicated by a reference numeral 202. In the recording operation, an end portion of the next recording zone is recorded on the spread area 202, with the result that the density of this portion becomes high. Particularly, this occurs with more frequency when multi-color images are superposedly recorded.

The degree of the spread is different if the material of the recording material 101 is different, and the degree of the stripe occurrence is not uniform. The apparatus includes a driving circuit 203 for an electrothermal transducer and an ink supply pipe 204. A reference numeral 205 designates the effected droplets, and the sizes of the liquid droplets ejected from the ejection outlet are substantially the same.

Japanese Laid-Open Patent Application No. 92851/1987 discloses one solution, in which in order to remove black or white stripes in the record, a smaller quantity of liquid is ejected from the orifice line of the recording head at both ends than from the other orifice line or lines, and the droplets from the opposite end orifice lines are superposed for each scanning lines.

This method involves a problem that in order to superpose a part of the previous recording, a part of the data for the previous scanning line has to be stored, with the result that the control for the recording becomes complicated, and it prevents the reduction of the cost and the structure simplification.

SUMMARY OF THE INVENTION

Accordingly, it is a principal object of the present invention to provide a liquid jet recording apparatus wherein the stripe or stripes do not appear in the junction between adjacent linear recording zones.

It is another object of the present invention to provide a liquid jet recording apparatus and method wherein the black or white stripe can be prevented without a complicated control system.

These and other objects, features and advantages of the present invention will become more apparent upon a consideration of the following description of the preferred embodiments of the present invention taken in conjunction with the accompanying drawings.

According to an aspect of the present invention, there is provided a serial type liquid jet recording apparatus, comprising: a recording head having an array of plural liquid ejecting means arranged in a column direction to eject droplets of recording liquid on a recording material; an end portion driving circuit for driving one or plural end liquid ejecting means of the plural ejecting means; a central portion driving circuit for driving the remaining liquid jet ejecting means; and adjusting means for adjusting a quantity of the droplet only from the end ejecting means by changing a voltage level or a pulse width of a driving voltage of said end portion driving circuit independently of said central portion driving circuit.

According to another aspect of the present invention, there is provided a liquid jet recording method wherein relative movement is imparted between a liquid jet recording head having a plurality of ejecting outlets and a recording material to scan the recording material, wherein a quantity of recording liquid end ejected from an ejection outlet or outlets is made smaller than a quantity from the rest of the ejection outlets, and wherein a recording zone covered by the (N)th scan and that by the (N+1)th scan is not overlapped.

According to a further aspect of the present invention, there is provided a liquid jet recording apparatus, comprising: a liquid jet recording head having a plurality of ejection outlets; a scanner for scanningly moving said recording head; a driving circuit for driving said recording head; said driving circuit including a first circuit for an end outlet of said ejection outlets and a second circuit for the rest of said ejection outlets, wherein said first circuit is adjustable independently from said second circuit.

PREFERRED EMBODIMENTS OF THE PRESENT INVENTION

According to the present invention, the size of the liquid droplets at the end portions of a recording zone covered by one scan are smaller than the middle droplets of the recording zone. Here, the end portions means the end, in a direction perpendicular to the scanning direction, of the linear recording zone covered by one scan. Therefore, a stripe does not appear in the junction between the record of (N)th scan (N is an integer not less than 1) and the record of (N+1)th scan, and therefore, faithful recording is possible.

In this invention, the stripe can be prevented even when recording materials (sheets of paper) having different spread ratios relative to the recording liquid are used, or when the spread ratio is locally different on one recording material.

Figure 1:
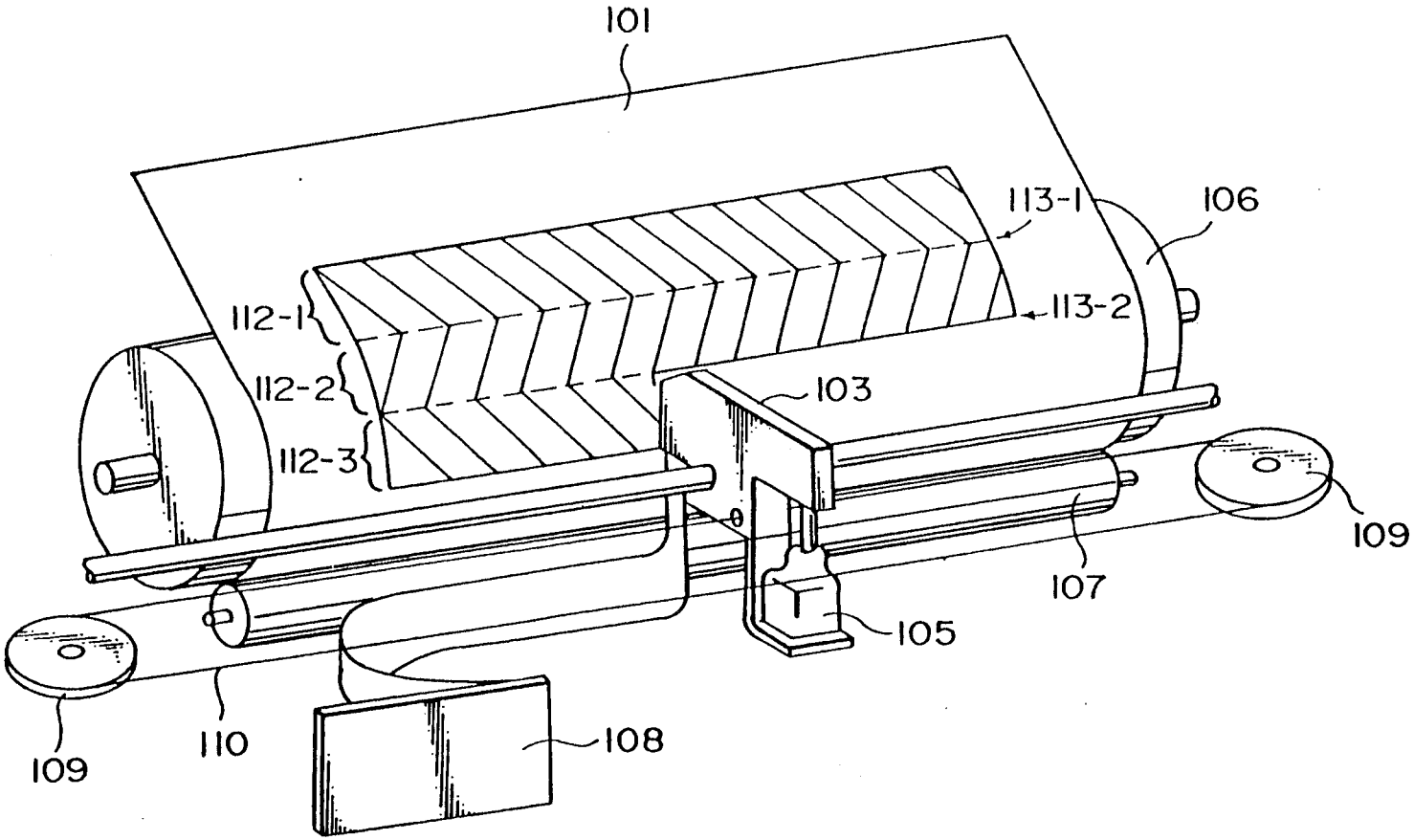
FIG. 1 PRIOR ART
FIG. 1 is a perspective view of a major part of a recording apparatus.
Figure 2:
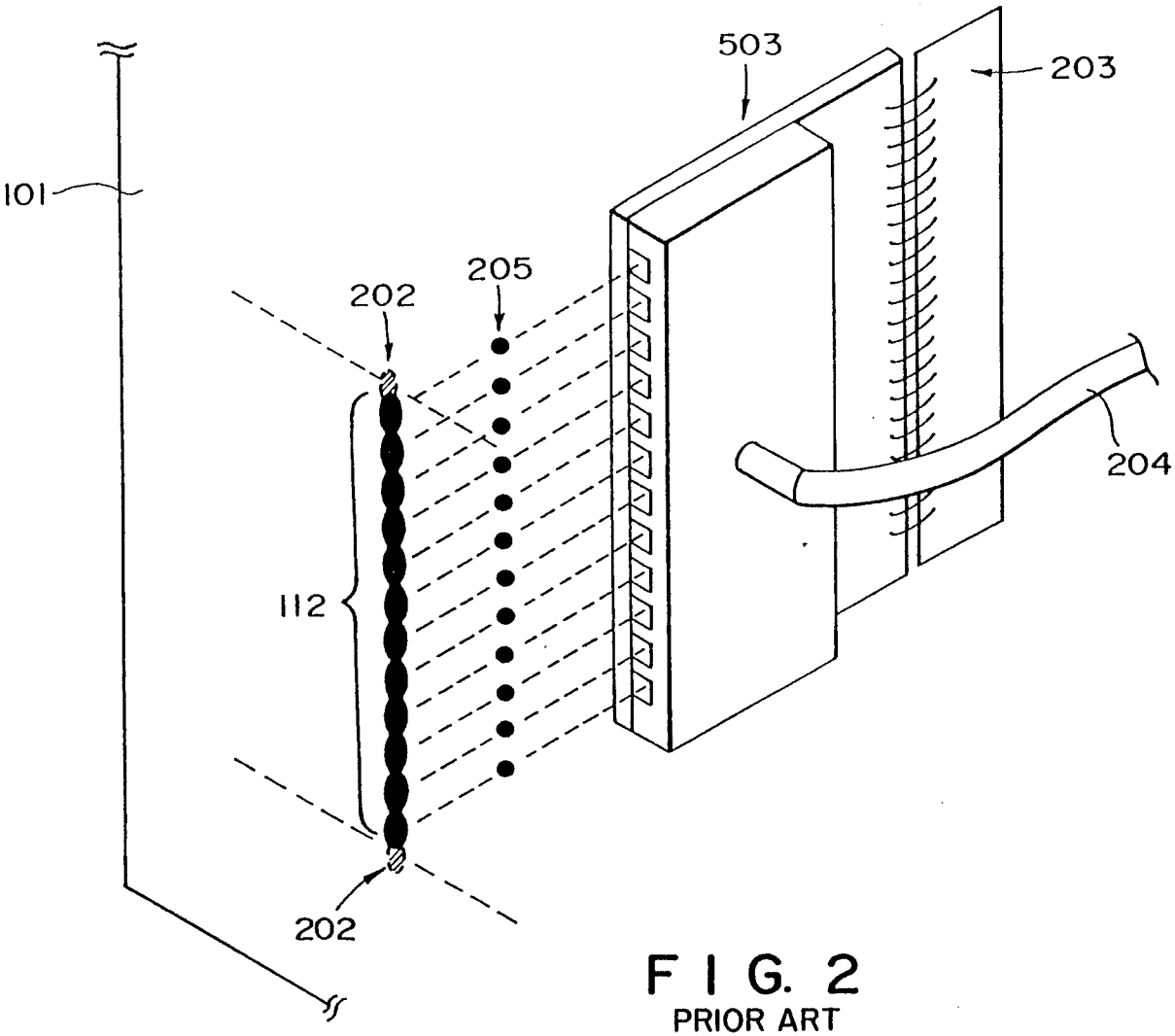
FIG. 2 PRIOR ART
FIG. 2 is an enlarged perspective view of a conventional recording head.
Figure 3:
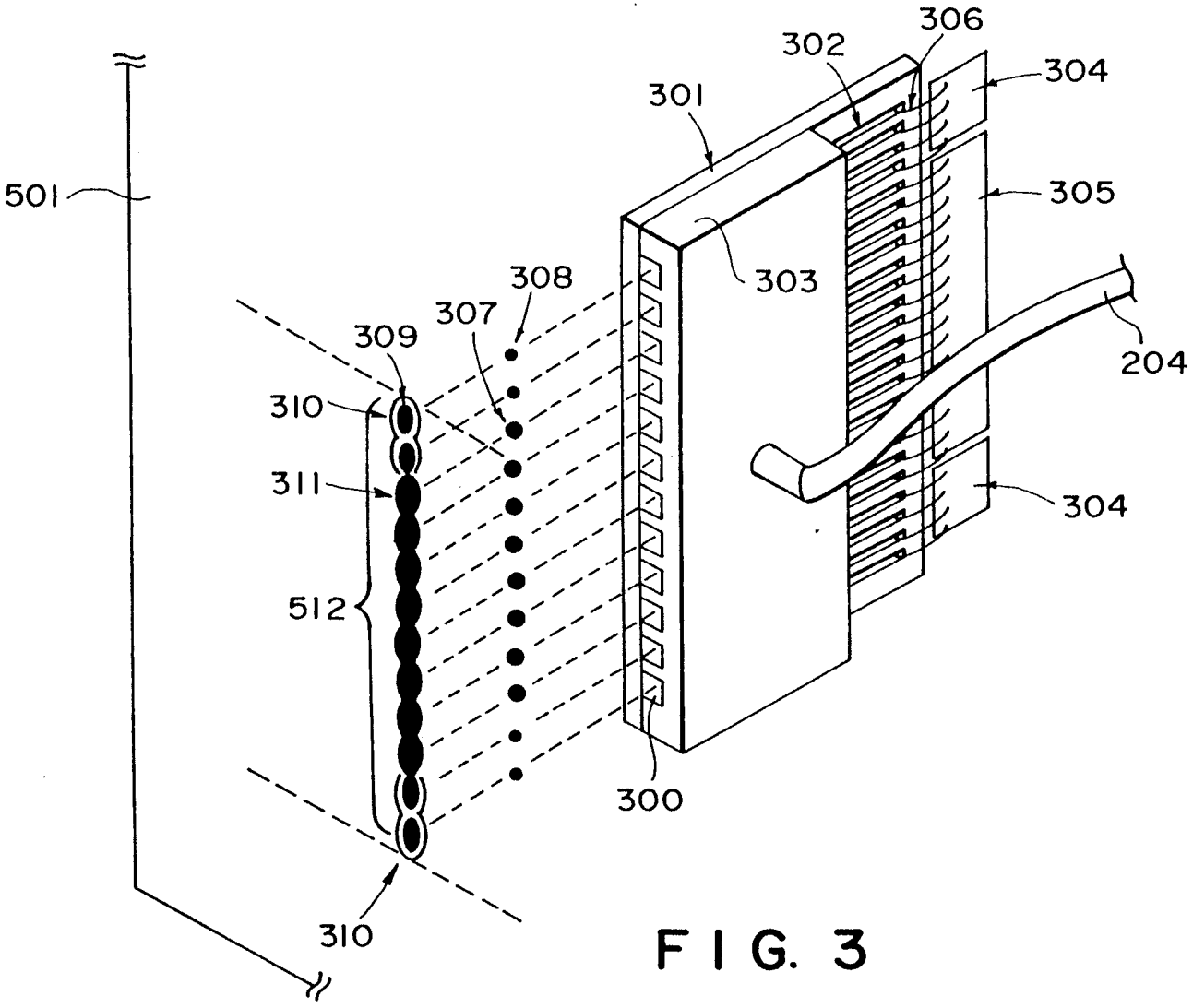
FIG. 3 is an enlarged perspective view of a recording head usable with a recording apparatus and process according to an embodiment of the present invention.

Referring now to FIG. 3, the embodiment of the present invention will be described. An ink jet recording head having plural ejection outlets has a substrate 301 made of glass or the like, electrothermal transducers (heat generating resistors) (not shown) made of $HfB_2$ or the like on the substrate, electrodes 302 made of aluminum or the like, which are produced by thin filming process or a photolithographic process. It further comprises a protection layer (not shown) made of $SiO_2$. A glass plate 303 having grooves corresponding to the electrothermal transducers is bonded on the substrate 301. The recording liquid is supplied from the liquid supply pipe 204 into the grooves. Electrothermal transducer driving circuits 304 and 305 are electrically connected to the electrodes 302 by wire bonding. The ink jet recording head is constructed in this manner.

The liquid jet recording head of this embodiment is usable in an on-demand type recording apparatus. The recording head includes a liquid ejecting portion constituted by orifices (ejection outlets) 300 formed to eject the liquid droplets 307 and 308 and heating portions communicating with the associated orifices 300 to apply thermal energy to the liquid to form the droplets. It also includes at least one pair of electrodes 302 electrically connected to the heat generating resistance layer on the substrate 301, wherein the electrothermal transducer is connected between the electrodes 302.

Figure 4:
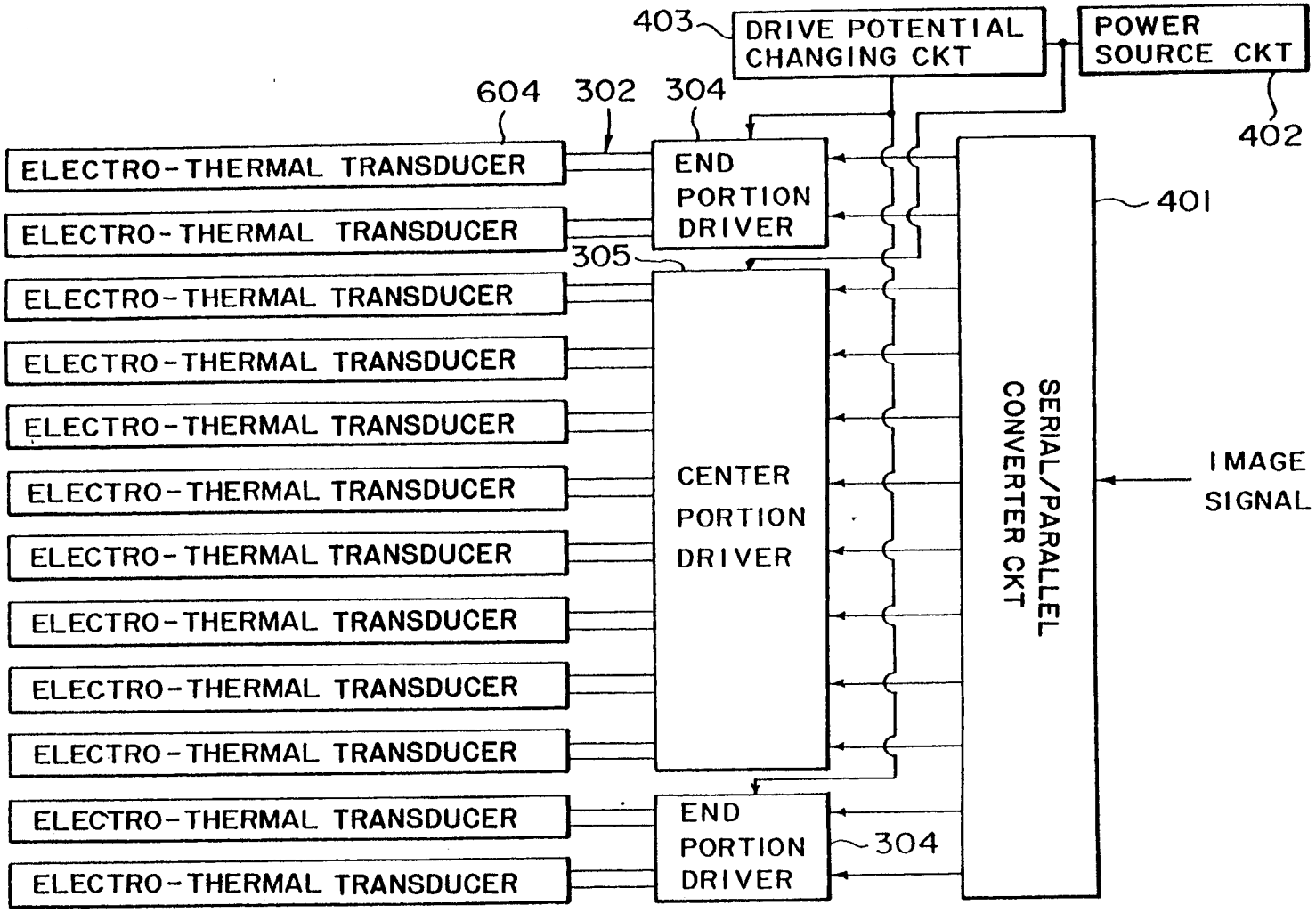
FIG. 4 is a block diagram of a circuit usable with the embodiment of FIG. 3.

The electrothermal transducers of four end orifices (top and bottom end) 300 out of twelve orifices are connected to the driving circuit 304 which is separate from the driving circuit 305 for the central eight orifices (FIG. 4).

The generally used recording ink supplied to the supply pipe 204 is dye ink of yellow, magenta, cyan or black color, although the colors and the material of the ink is not limited to those.

The "spread ratio" is defined as "D/d", where d is a diameter of a droplet of the recording ink, and D is a diameter of the picture element recorded on the recording material 501. The recording operation was carried out with the recording material and the recording material driving conditions adjusted so as to align the adjacent records. However, when the driving voltage of the end driving circuit 304 and that of the central driving circuit 305 were the same, the stripe (pattern) appeared at the junction if the spread ratio of the recording material 501 was not less than 3.05.

When the driving voltage only of the end driving circuit 304 was lowered by 5% while watching the production of the stripe on the recording material 501, it was confirmed that the recording without the production of the stripe was possible on the recording material having the spread ratio lower than 3.15, without deteriorating the other record quality.

FIG. 3 shows the recording state under this condition, wherein reference numeral 307 designates the jet droplets in the central portion having a normal size; 308, a smaller droplet at the end portion; 309, the recorded picture element provided only by the droplet 308; 310, a picture element including the spread peculiar to the end portions; and 311, the recorded picture element in the central portion. The sizes of the picture elements 310 and 311 recorded are substantially the same. Therefore, the recorded picture element does not spread over the recording region 512, and therefore the stripe is not produced.

In place of the recording head using the thermal energy, a piezoelectric jet head using electrostrictive elements may be used.

It has also been confirmed that the same advantageous effects can be obtained when the pulse width of the driving voltage is reduced by about 14% in place of the driving pulse voltage, in the end control circuit 304. In addition, it has been confirmed that the combination of these changes is also effective.

FIG. 4 shows the structure of the control circuit for the apparatus of this embodiment. The circuit includes a serial-parallel converting circuit 401 for producing a parallel image signal (dot signal) to the driving circuits 304 and 305, a power source circuit 402 for supplying a constant driving voltage, and a driving voltage changing circuit 403 for manually lowering the driving voltage supplied from the power source circuit 402. The driving voltage changing circuit 403 may include a variable resistor, a variable capacitor or the like. The constant voltage produced by the power source circuit 402 is supplied to a central driving circuit 305, as it is, and the relatively low voltage adjusted by the driving voltage changing circuit 403 is supplied to the end driving circuit 304. The electrothermal transducers 604 are connected to the driving circuit 304 or 305 through the electrodes 302.

In place of the driving voltage changing circuit 403, a driving pulse width changing circuit for reducing the width of the driving pulse may be used to adjust the width of the driving pulse to be supplied to the end portion driving circuit 304.

In summary, according to the present invention, an adjusting means (circuit) for making the size (quantity) of the liquid droplet 308 (FIG. 3) ejected from the end portions smaller than that of the droplet 307 produced from the central portion is provided for the end driving circuit 304. That is, the quantity of the liquid droplet from the end portions is controlled independently from that from the central portions.

In this embodiment, the end portion driving circuit and the central portion driving circuit 305 are shown separately. However, in the actual apparatus, it is not necessary to construct these circuits as separate semiconductor devices, and instead, these circuits may be constituted as one semiconductor device.

In order to change the size of the liquid ejected, it is possible that the size of the ejection outlet is changed, the size of the heat generating portion of the electrothermal transducer is changed, or these are combined, or further one or more of these are combined with the structure described in the above embodiment. However, in the present invention, the recording zone covered by one scan does not overlap with the other recording zone covered by the other scan.

In the above embodiment, the driving pulse width and/or the driving voltage is changeable, so that the good recording operation is possible on various recording sheets having greatly different spread ratio. However, it or they may be fixed for the purpose of simplification of the structure.

The end portion driving circuit may be employed only for one (top or bottom) end of the recording zone. The end portion driving circuit may be connected to the bottommost or topmost ejection outlet.

As described in the foregoing, according to the present invention, the driving means for the end part of an array of liquid ejection outlets is adjustable independently from a driving means for the other outlets, so that one or plural end droplets are changed from the rest by changing the driving voltage and/or the driving pulse width or the like, by which the stripe production is prevented at the junction between one linear recording zone and the next zone. Thus, images faithful to the input information without stripe pattern can be provided. In addition, the apparatus according to the present invention can be used with a wider variety of recording materials having different spread ratios.

While the invention has been described with reference to the structures disclosed herein, it is not confined to the details set forth and this application is intended to cover such modifications or changes as may come within the purposes of the improvements or the scope of the following claims.

What is claimed is:

1. A serial type liquid jet recording apparatus comprising:

a recording head having an array of plural liquid ejecting means arranged in a column direction to eject droplets of recording liquid on a recording material, said array including at least one end liquid ejecting means and central liquid ejecting means;

an end portion driving circuit for driving at least one of said end liquid ejecting means;

a central portion driving circuit for driving the central liquid ejecting means; and adjusting means for adjusting a volume of the droplets only from said end liquid ejecting means driven by said end portion driving circuit, said adjusting means changing a driving signal of said end portion driving circuit independently of said central portion driving circuit.

2. An apparatus according to claim 1, wherein said adjusting means changes one of a voltage level and a pulse width of the driving signal.

3. A liquid jet recording method wherein relative movement is imparted between a liquid jet recording head having a plurality of ejecting outlets including end ejection outlets and a recording material to scan the recording material, said method comprising the step of:

decreasing the volume of recording liquid ejected from at least one end ejection outlet relative to a volume ejected from other ejection outlets, wherein a recording zone covered by an (N)th scan and a recording zone covered by an (N+1)th scan are not overlapped, N being an integer not less than 1.

4. A method according to claim 3, wherein the liquid is ejected using thermal energy.

5. A method according to claim 3, wherein said decreasing step is effected by changing a driving signal.

6. A method according to claim 5, wherein the recording liquid is ejected in response to a driving signal and said volume decreasing step is effected by changing one of a voltage level and a pulse width of the driving signal.

7. A liquid jet recording apparatus comprising:

a liquid jet recording head having a plurality of ejection outlets including at least one end ejection outlet and central ejection outlets;

a scanner for scanning said recording head;

a driving circuit for driving said recording head, said driving circuit including a first circuit for said at least one end ejection outlet and a second circuit for said central ejection outlets, wherein said first circuit is adjustable independently from said second circuit.

8. An apparatus according to claim 7, wherein said driving circuit is electrically connected to electrothermal transducers provided for said plurality of ejection outlets.

9. An apparatus according to claim 7, wherein said first and second circuits are integrally formed.

10. An apparatus according to claim 7, wherein said at least one end outlet carries out recording at an end of a recording region.

11. An apparatus according to claim 7, wherein a plurality of said at least one ejection outlets are driven by said first circuit.

12. A recording apparatus comprising:

an ink jet recording head having an array of ejection outlets;

main scan means for scanning said recording head in a scanning direction relative to a recording material;

driving means for driving said recording head to eject ink droplets from said outlets by supplying driving signals to said recording head in accordance with data to be recorded, wherein said driving means adjusts the driving signals in accordance with a relative positions of said outlets in said array.

13. An apparatus according to claim 12, wherein said driving means decreases a volume of the ejected ink droplets at end positions in the array.

14. An apparatus according to claim 13, wherein said driving means decreases the volume of the droplets by decreasing a voltage level of the driving signals.

15. An apparatus according to claim 13, wherein said driving means decreases the volume of the droplets by decreasing a pulse width of the driving signals.

16. An apparatus according to claim 12, further comprising sub-scan means for imparting relative movement between said recording head and the recording material in a sub-scan direction orthogonal to the scanning direction, wherein a recording zone covered by an (N)th scan and a recording zone covered by an (N+1)th scan are not overlapped.

17. An apparatus according to claim 12, wherein said recording head includes a thermal energy generating means for each ejection outlet in said array.

18. An apparatus according to claim 17, wherein each thermal energy generating means generates thermal energy in ink to eject ink droplets through corresponding ejection outlet.

* * * * *

UNITED STATES PATENT AND TRADEMARK OFFICE

CERTIFICATE OF CORRECTION

PATENT NO. : 5,132,702

DATED : July 21, 1992

INVENTOR(S) : ATSUSHI SHIOZAKI, ET AL.

It is certified that error appears in the above-identified patent and that said Letters Patent is hereby corrected as shown below:

COLUMN 2:

Line 59, "end" should be deleted;

Line 60, "an ejection" should read --an end ejection--.

COLUMN 3:

Line 24, "end," should read --ends,--.

COLUMN 6:

Line 6, "the" should read --a--;

Line 7, "a" should read --the--;

Line 55, "a" should be deleted.

Signed and Sealed this

Fifth Day of October, 1993

*Attest:*

*Attesting Officer*

BRUCE LEHMAN

*Commissioner of Patents and Trademarks*